US008905506B2

(12) United States Patent
Fukuda et al.

(10) Patent No.: US 8,905,506 B2
(45) Date of Patent: Dec. 9, 2014

(54) LIQUID EJECTING APPARATUS AND METHOD OF CONTROLLING LIQUID EJECTING APPARATUS THAT CORRECTS FOR AGING OF A PRINT HEAD

(75) Inventors: Masako Fukuda, Nagano (JP); Satoshi Kimura, Nagano (JP); Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 198 days.

(21) Appl. No.: 13/558,048

(22) Filed: Jul. 25, 2012

(65) Prior Publication Data

US 2013/0027453 A1 Jan. 31, 2013

(30) Foreign Application Priority Data

Jul. 26, 2011 (JP) ..... 2011-162895

(51) Int. Cl.
*B41J 29/38* (2006.01)
*B41J 2/045* (2006.01)

(52) U.S. Cl.
CPC ..... *B41J 29/38* (2013.01); *B41J 2/04536* (2013.01); *B41J 2/04581* (2013.01)
USPC ..... 347/10

(58) Field of Classification Search
CPC ..... B41J 29/38; B41J 2/04581; B41J 2/04536
USPC ..... 347/10, 14
See application file for complete search history.

(56) References Cited

U.S. PATENT DOCUMENTS

2010/0220137 A1 * 9/2010 Shindo ..... 347/14

FOREIGN PATENT DOCUMENTS

| | | | |
|---|---|---|---|
| JP | 08-039825 | | 2/1996 |
| JP | 2001138498 | * | 5/2001 |
| JP | 2009-066948 | | 4/2009 |

* cited by examiner

*Primary Examiner* — Alessandro Amari
*Assistant Examiner* — Carlos A Martinez
(74) *Attorney, Agent, or Firm* — Workman Nydegger

(57) ABSTRACT

A CPU serving as a counting unit counts the cumulative number of times a driving pulse is applied to a piezoelectric vibrator. A driving signal generation unit is able to generate an aging driving pulse set by a driving parameter to the extent that ink is not ejected from a nozzle and performs an aging process of driving the piezoelectric vibrator using the aging driving pulse set by a driving parameter in accordance with a cumulative number of applications in a region outside an ejection region on a recording medium.

8 Claims, 9 Drawing Sheets

LIQUID EJECTING APPARATUS AND METHOD OF CONTROLLING LIQUID EJECTING APPARATUS THAT CORRECTS FOR AGING OF A PRINT HEAD

BACKGROUND

1. Technical Field

The present invention relates to a liquid ejecting apparatus such as an ink jet recording apparatus and a method of controlling the liquid ejecting apparatus, and more particularly, to a liquid ejecting apparatus which drives a pressure generation unit by applying a driving waveform of a driving signal to the pressure generation unit and ejects a liquid from nozzles by causing a change in a pressure of the liquid in a pressure chamber communicating with the nozzle and a method of controlling the liquid ejecting apparatus.

2. Related Art

A liquid ejecting apparatus is an apparatus that includes an ejection head and jets (ejects) various kinds of liquids from the ejection head. As the liquid ejecting apparatus, an image recording apparatus such as an ink jet printer or an ink jet plotter can be exemplified. In recent years, the liquid ejecting apparatus has been applied to various kinds of manufacturing apparatuses, since the liquid ejecting apparatus has characteristics in which a very small amount of liquid can be accurately landed on a predetermined position. The liquid ejecting apparatus is applied to, for example, a display manufacturing apparatus that manufactures a color filter such as a liquid crystal display, an electrode forming apparatus that forms an electrode of an organic EL (Electro-Luminescence) display, an FED (Field Emission Display), or the like, a chip manufacturing apparatus that manufactures a biochip (biochemical element). A recording head of an image recording apparatus ejects liquid-phase ink and a color material ejecting head of a display manufacturing apparatus ejects solutions of color materials of R (Red), G (Green), and B (Blue). Further, an electrode material ejecting head of an electrode forming apparatus ejects a liquid-phase electrode material and a bio-organic substance ejecting head of a chip manufacturing apparatus ejects a solution of a bio-organic substance.

A liquid ejecting head is configured such that the pressure of a functional liquid in a pressure chamber is changed by applying a driving waveform to a pressure generation unit such as a piezoelectric vibrator and driving the pressure generation unit, and the change in the pressure causes a liquid to be ejected from nozzles. In a liquid ejecting head using such a liquid ejection method, it is known that the characteristics such as an amount of displacement are changed with an increase in the number of times of driving. For example, when a piezoelectric vibrator which is a kind of pressure generation unit is repeatedly driven, polarization characteristics are changed and the amount of displacement thus tends to deteriorate. The change in the polarization characteristics is caused since the repetition of the driving causes a piezoelectric body to be polarized in a direction different from the direction of an applied electric field. When the characteristics change (deteriorate), a problem may arise in that an amount of ink to be ejected from nozzles or flying speed (ejection characteristic) deteriorates when the driving waveform of the initial setting is used and the pressure generation unit is driven. Further, since the degree of change in a variation in the characteristics occurs depending on the use status of the nozzles, for example, there is a concern that unevenness or streaks may occur in a recorded image or the like.

To resolve this problem, a configuration in which the ejection characteristics are prevented from deteriorating by correcting a driving voltage depending on a driving status of a pressure generation unit of each nozzle line has been suggested (for example, see JP-A-2009-066948).

In this configuration, however, the driving voltage increases as the characteristics gradually deteriorates. Therefore, since the pressure generation unit corresponding to the relatively frequently used nozzles further deteriorates, there is a concern that the variation in the characteristics further worsens.

SUMMARY

An advantage of some aspects of the invention is that it provides a liquid ejecting apparatus capable of unifying the characteristics of pressure generation units irrespective of a driving frequency and a method of controlling the liquid ejecting apparatus.

According to an aspect of the invention, there is provided a liquid ejecting apparatus including: a liquid ejecting head that includes a nozzle group in which a plurality of nozzles are arranged and a pressure generation unit causing a change in pressure inside a pressure chamber communicating with the nozzle and that causes the pressure generation unit to eject a liquid from the nozzles; a driving waveform generation unit that generates a driving waveform used to drive the pressure generation unit; a control unit that controls ejection of the liquid by the liquid ejecting head; and a counting unit that counts a cumulative number of times the driving waveform is applied. The driving waveform generation unit generates a non-ejection driving waveform. A driving parameter of the non-ejection driving waveform includes at least one of a driving voltage, a potential change ratio per unit time, a hold time in which a potential is constantly held, and the number of times a pulse is continuously applied. The control unit drives the pressure generation unit using the non-ejection driving waveform set in accordance with the cumulative number of times the driving waveform is applied.

According to the aspect of the invention, since the pressure generation unit is driven using the non-ejection driving waveform set by the driving parameter in accordance with the cumulative number of times the driving waveform is applied, an aging process can be performed to the extent that each pressure generation unit deteriorates. Thus, a variation in the characteristics of the pressure generation units corresponding to the nozzles of the same nozzle group can be reduced. As a result, the ejection characteristics of the nozzles can match each other as far as possible. Further, since the non-ejection driving waveform causes no ejection of the liquid, the ink is not unnecessarily consumed in the aging process.

The aging process according to the aspect of the invention is a process of driving the pressure generation unit using the non-ejection driving waveform set by the driving parameter in accordance with the cumulative number of times the driving waveform is applied to match the characteristics of the pressure generation units in which the variation occurs substantially equally.

In the liquid ejecting apparatus having the above-described configuration, the control unit may have a recording region where recording is performed in the main scanning of the liquid ejecting head and a region outside the recording region and drive the pressure generation unit in the region outside the recording region using the non-ejection driving waveform set in accordance with the cumulative number of times the driving waveform is applied.

With such a configuration, since the aging process is performed in the region outside the recording region, it is not necessary to separately provide a period in which the aging process is performed and deterioration in throughput can be prevented.

In the liquid ejecting apparatus having the above-described configuration, a driving intensity of the driving parameter may be set lower when the cumulative number of times the driving waveform is applied is relatively larger than when the cumulative number of times the driving waveform is applied is relatively smaller.

In the liquid ejecting apparatus having the above-described configuration, the non-ejection driving waveform may be a direct-current voltage.

With such a configuration, since the non-ejection driving waveform is the direct-current voltage, the state displacement of the pressure generation unit is not repeated, the liquid in the pressure chamber is not agitated. Therefore, the liquid thickened near the nozzle can be prevented from being received in the pressure chamber. Accordingly, after the aging process, it is not necessary to perform a so-called flushing process of flushing out the liquid to discharge the thickened liquid.

In the liquid ejecting apparatus having the above-described configuration, the non-ejection driving waveform may be a trapezoidal wave.

With such a configuration, since the non-ejection driving waveform is a trapezoidal wave, a minute vibration process of minutely vibrating a meniscus of the nozzle to the extent that the liquid is not ejected from the nozzle is performed also by the aging process, it is not necessary to perform the minute vibration process, and therefore efficiency is good.

In the liquid ejecting apparatus having the above-described configuration, the non-ejection driving waveform may be a triangular wave or a saw-toothed wave.

With such a configuration, since the non-ejection driving waveform is the triangular wave or the saw-toothed wave, conversion of displacement of the pressure generation unit is steep. Thus, a load increases when the pressure generation unit is driven using the non-ejection driving waveform set in accordance with the number of times the driving waveform is applied. Accordingly, the variation in the characteristics of the pressure generation units can be reduced more efficiently.

According to another aspect of the invention, there is provided a method of controlling a liquid ejecting apparatus including a liquid ejecting head that includes a nozzle group in which a plurality of nozzles are arranged and a pressure generation unit causing a change in pressure inside a pressure chamber communicating with the nozzle and that causes the pressure generation unit to eject a liquid from the nozzles; a driving waveform generation unit that generates a driving waveform used to drive the pressure generation unit; a control unit that controls ejection of the liquid by the liquid ejecting head; and a counting unit that counts a cumulative number of times the driving waveform is applied. The driving waveform generation unit generates a non-ejection driving waveform based on a driving parameter. A driving parameter includes at least one of a driving voltage, a potential change ratio per unit time, a hold time in which a potential is constantly held, and the number of times a pulse is continuously applied. The control unit drives the pressure generation unit using the non-ejection driving waveform set in accordance with the cumulative number of times the driving waveform is applied.

In the method according to this aspect of the invention, the control unit may have a recording region where recording is performed in the main scanning of the liquid ejecting head and a region outside the recording region and perform the aging process in the region outside the recording region.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. The embodiments described below are limited as various specific preferred embodiments of the invention, but the scope of the invention is not limited thereto unless the invention is otherwise limited in the following description. Hereinafter, an ink jet recording apparatus (hereinafter, referred to as a printer) will be described as the liquid ejecting apparatus according to the invention.

Figure 1:
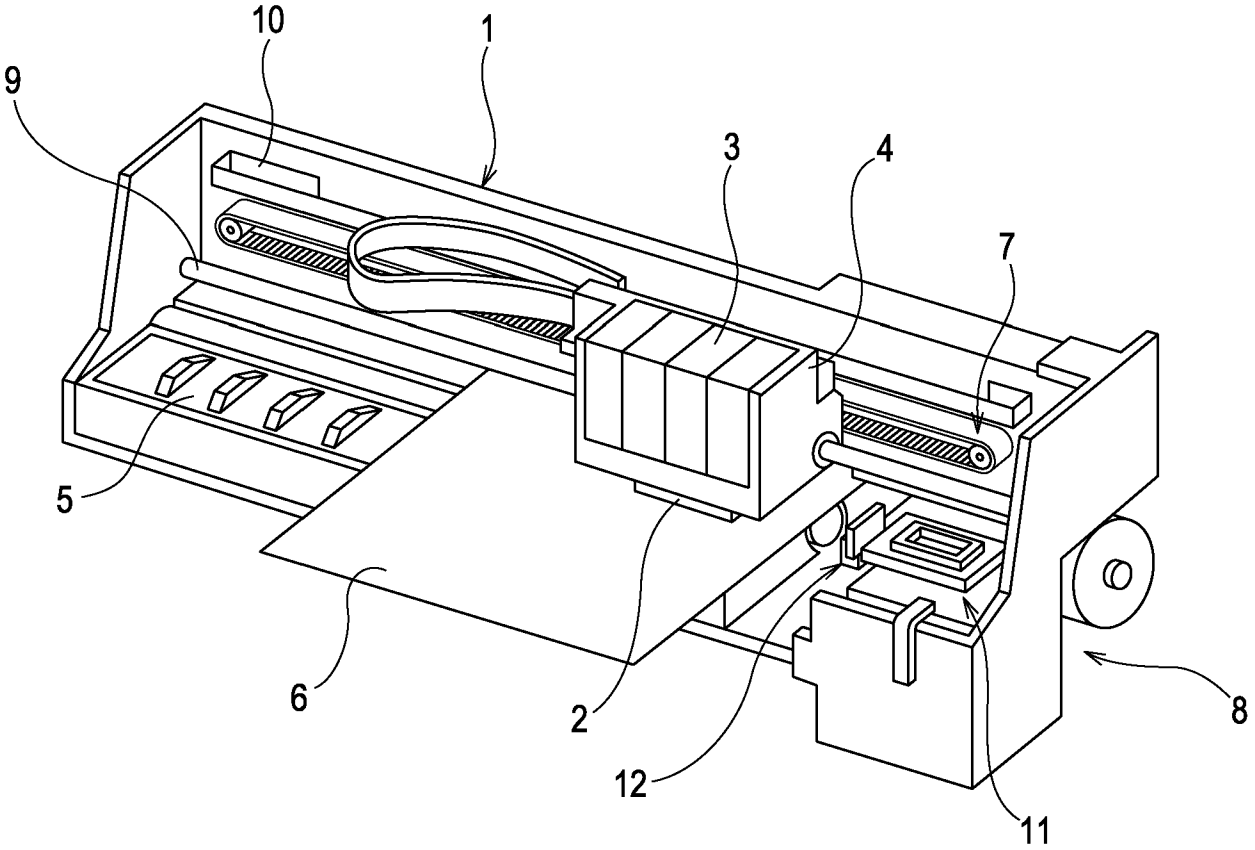
FIG. 1 is a perspective view illustrating the configuration of a printer.

FIG. 1 is a perspective view illustrating the configuration of a printer 1. The exemplified printer 1 ejects ink which is a kind of liquid toward a recording medium (liquid landing target) such as a recording sheet 6, a cloth, or a film from a recording head 2 which is a kind of liquid ejecting head. The printer 1 includes a carriage 4 on which the recording head 2 is mounted and an ink cartridge 3 which is a kind of liquid supply source is detachably mounted, a platen 5 located below the recording head 2 when a recording process is performed, a carriage movement mechanism 7 which reciprocates the carriage 4 in a sheet surface direction of the recording sheet 6, that is, in a main scanning direction, and a sheet feeding mechanism 8 that feeds the recording sheet 6 in a sub-scanning direction perpendicular to the main scanning direction.

The carriage 4 is mounted on a guide rod 9 installed in the main scanning direction so as to be shaft-supported and is configured to move among the guide rod 9 in the main scanning direction when the carriage movement mechanism 7 operates. The position of the carriage 4 in the main scanning direction is detected by a linear encoder 10 and a detection signal, that is, an encoder pulse (which is a kind of position information) is transmitted to a CPU 38 (see FIG. 4) of a printer controller 36. The linear encoder 10 is a kind of position information output unit and outputs the encoder pulse corresponding to the scanning position of the recording head 2 as position information of the main scanning direction. Therefore, the CPU 38 can recognize the scanning position of the recording head 2 mounted on the carriage 4 based on the received encoder pulse. That is, for example, the CPU 38 can recognize the position of the carriage 4 by counting the received encoder pulses. Thus, the CPU 38 can recognize the scanning position of the carriage 4 (the recording head 2) based on the encoder pulses from the linear encoder 10, and thus can control a recording process of the recording head 2.

A home position which is a base position of the scanning of the carriage 4 is set at an end region outside a recording region within the movement range of the carriage 4. In this embodiment, a wiper member 12 that sweeps a capping member 11 sealing a nozzle formation surface (a nozzle plate 29: see FIGS. 2 and 3 and the like) of the recording head 2 and the nozzle formation surface is disposed at the home position. The printer 1 performs a bi-directional recording process of recording characters, images, or the like on the recording sheet 6 in both directions, that is, a forward direction in which the carriage 4 is moved from the home position to the end portion opposite to the home position and a backward direction in which the carriage 4 returns from the end portion opposite to the home position to the home position.

Figure 2:
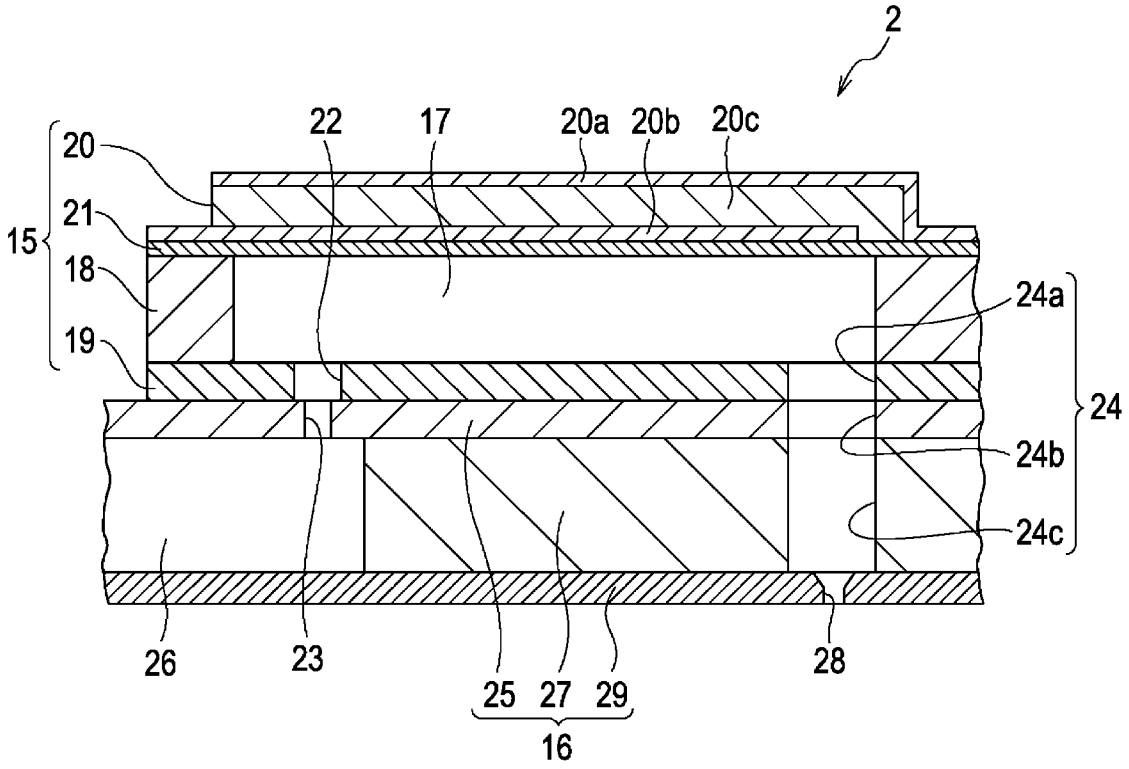
FIG. 2 is a perspective view illustrating the configuration of a recording head.

FIG. 2 is a sectional view illustrating the main units in the configuration of the recording head 2. The recording head 2 according to this embodiment includes a pressure generation unit 15 and a passage unit 16. The pressure generation unit 15 and the passage unit 16 are superimposed to be integrally formed. The pressure generation unit 15 is configured such that a pressure chamber plate 18 which partitions pressure chambers 17, a communication opening plate 19 in which a supply-side communication opening 22 and a first communication opening 24*a* are formed, and a vibration plate 21 on which a piezoelectric vibrator 20 is mounted are laminated and integrally formed by baking. The passage unit 16 is configured such that a supply opening plate 25 in which a supply port 23 and a second communication opening 24*b* are formed, a reservoir plate 27 in which a reservoir 26 and a third communication opening 24*c* are formed, and a plate member formed by a nozzle plate 29 in which nozzles 28 are formed are laminated and attached to each other.

Figure 3:
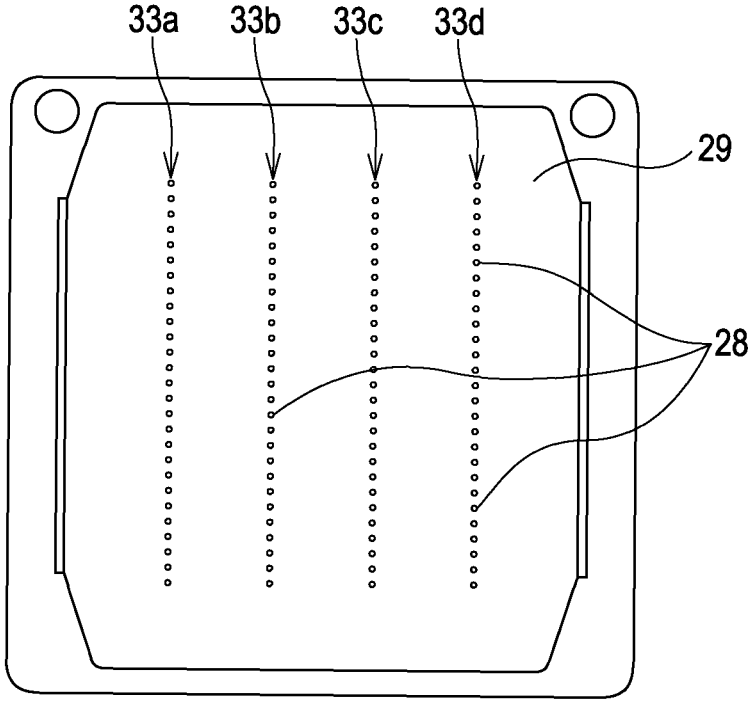
FIG. 3 is a plan view illustrating the configuration of a nozzle plate.

FIG. 3 is a diagram illustrating the configuration of the nozzle plate 29. In the nozzle plate 29 according to this embodiment, nozzle lines 33 (which are a kind of nozzle group) in which 360 nozzles 28 ejecting ink are lined up in parallel to a transport direction of the recording sheet 2 are formed. The nozzle line 33 according to this embodiment includes the nozzles 28 opened at a formation pitch of, for example, 360 dpi. A total of four nozzle lines (33*a* to 33*d*) are formed in the nozzle plate 29. A band recording process using the nozzle lines 33 will be described in detail later. The number of nozzles 28 of one nozzle line 33 and the number of nozzle lines 33 are not limited to the mentioned examples.

The piezoelectric vibrator 20 is arranged on the outside surface of the vibration plate 21 opposite to the pressure chamber 17 so as to correspond to each pressure chamber 17. The exemplified piezoelectric vibrator 20 is a piezoelectric vibrator of a so-called flexible vibration mode. In the piezoelectric vibrator 20, a piezoelectric body 20*c* is interposed between a driving electrode 20*a* and a common electrode 20*b*. When a driving signal (driving pulse) is applied to the driving electrode 20*a* of the piezoelectric vibrator 20, an electric field corresponding to a potential difference between the driving electrode 20*a* and the common electrode 20*b* is generated. When this electric field is applied to the piezoelectric body 20*c*, the piezoelectric body 20*c* is deformed in accordance with the magnification of the applied electric field. That is, as the potential of the driving electrode 20*a* increases, the middle portion of the piezoelectric body 20*c* in the width direction (nozzle line direction) thereof is curved toward the inside (a side closer to the nozzle plate 29) of the pressure chamber 17 and the vibration plate 21 is thus deformed so that the volume of the pressure chamber 17 decreases. On the other hand, as the potential of the driving electrode 20*a* decreases, the middle portion of the piezoelectric body 20*c* is curved toward the outside (a side more distant from the nozzle plate 29) of the pressure chamber 17 and the vibration plate 21 is deformed so that the volume of the pressure chamber 17 increases.

Next, an electrical configuration of the printer 1 will be described.

Figure 4:
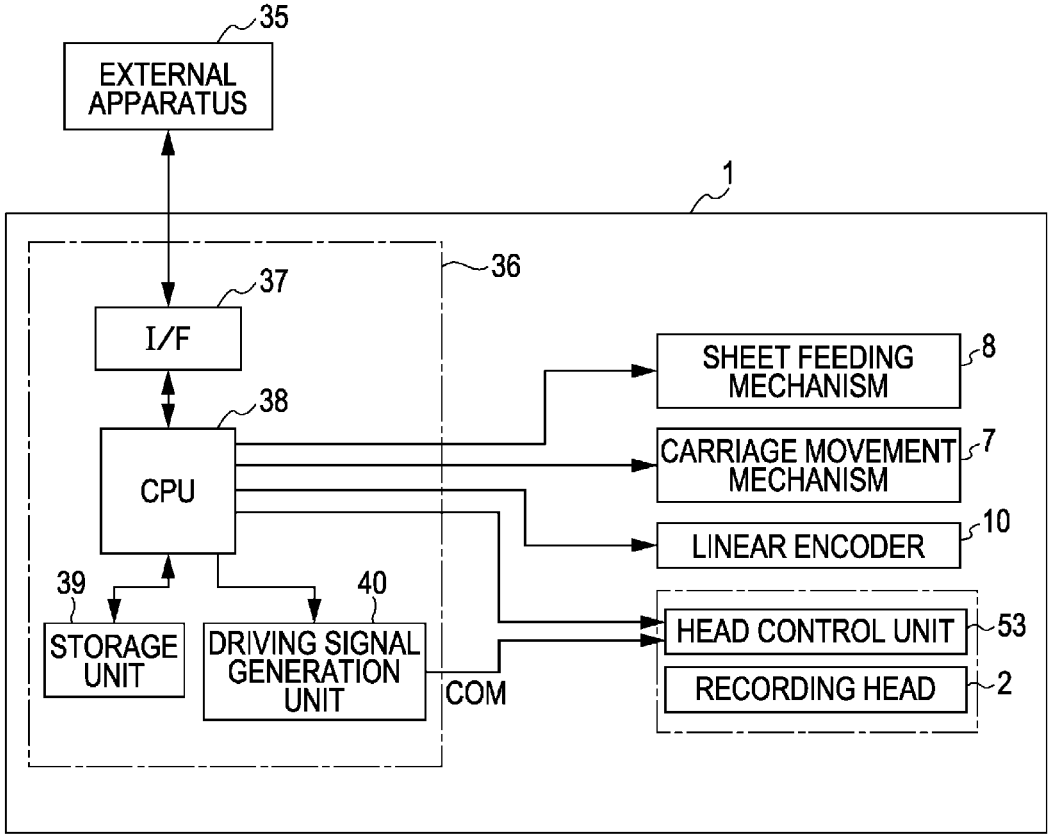
FIG. 4 is a block diagram illustrating an electrical configuration of the recording head.

FIG. 4 is a block diagram illustrating the electrical configuration of the printer 1. An external apparatus 35 is, for example, a computer or an electronic apparatus, such as a digital camera, that handles an image. The external apparatus 35 is connected to the printer 1 so as to communicate with the printer 1. Thus, the external apparatus 35 transits print data corresponding to an image, text, or the like to the printer 1 in order to cause the printer 1 to print the image, text, or the like on a recording medium such as a recording sheet.

The printer 1 according to this embodiment includes a sheet feeding mechanism 8, the carriage movement mechanism 7, the linear encoder 10, the recording head 2, and the printer controller 36.

The printer controller 36 is a control unit that is a kind of control unit of the invention and controls each unit of the printer. The printer controller 36 includes an interface (I/F) unit 37, the CPU 38, a storage unit 39, and a driving signal generation unit 40. The interface unit 37 transmits and receives printer state data. For example, the interface unit 37 transmits print data or a print command from the external apparatus 35 to the printer 1 or receives state information on the printer 1 by the external apparatus 35. The CPU 38 is an arithmetic processing device that controls the entire printer. The storage unit 39 is an element that stores a program of the CPU 38 or data used to perform various controls. Examples of the storage unit 39 include a ROM, a RAM, an NVRAM (non-volatile storage element). The CPU 38 controls each unit in accordance with the program stored in the storage unit 39.

Figure 5A:
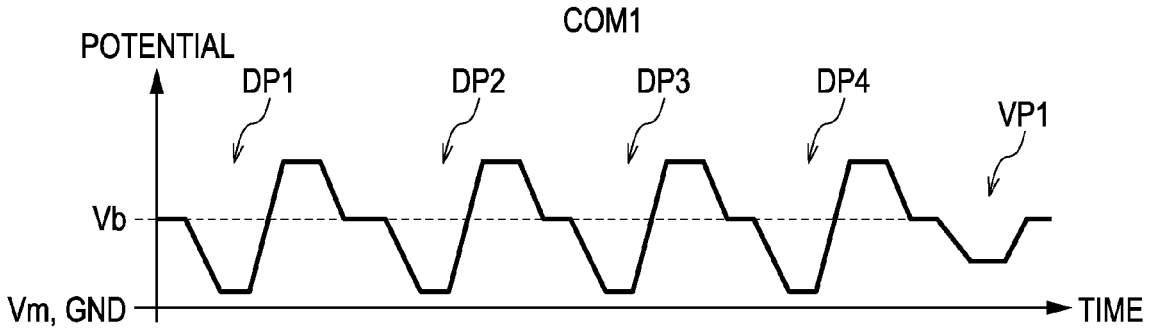
FIGS. 5A and 5B are diagrams illustrating the configurations of the waveforms of driving signals.

The driving signal generation unit 40 is a unit that functions as a driving waveform generation unit of the invention. The driving signal generation unit 40 generates an analog voltage signal based on waveform data regarding the waveforms of a driving signal. The driving signal generation unit 40 generates a driving signal COM by amplifying the voltage signal. The printer 1 according to this embodiment can perform a multi-gray-scale recording process of forming different sizes of dots on the recording sheet 6 by ejecting ink droplets with different amounts of liquid. In this embodiment, the printer 1 is configured to perform a recording process of recording four gray scales of a large dot, a middle dot, a small dot, and a non-ejection (minute vibration). The driving signal generation unit 40 generates a first driving signal COM1 that includes a first ejection driving pulse DP1, a second ejection driving pulse DP2, a third ejection driving pulse DP3, and a fourth ejection driving pulse DP4, and an in-printing minute vibration pulse VP1 (all of which are kinds of driving waveforms in the invention) used to minutely vibrate the meniscus of the nozzle 28 that is ejecting no ink, for example, as shown in FIG. 5A. The first driving signal COM1 is a driving signal used when the ink is ejected toward the recording medium (the recording sheet 6) to record (print) an image, text, or the like. When the recording head 2 is moved in a printing region (which is a region in which dots are recorded (dots are formed) by a one-time pass (main scanning)) at a constant speed (hereinafter, simply referred to as a constant-speed movement time), one driving pulse selected from the driving pulses of the first driving signal COM1 is applied to the piezoelectric vibrator 20.

The ejection driving pulses DP1 to DP4 are driving pulses of which a driving voltage (which is a potential difference between the minimum potential and the maximum potential of the driving pulse), a waveform, or the like is determined to eject the ink from the nozzles 28. The size of the dot to be recorded on the recording medium is changed depending on the number of ejection driving pulses selected from the ejection driving pulse of the driving signal COM1. Specifically, when all of the four ejection driving pulses DP1 to DP4 are selected and applied to the piezoelectric vibrator 20, the ink is continuously ejected four times from the nozzles 28. When the ink is landed on a predetermined pixel region on the recording medium, a large dot is formed. Likewise, when two of the ejection driving pulses, for example, the first ejection driving pulse DP1 and the third ejection driving pulse DP3, are selected and applied to the piezoelectric vibrator 20, the ink is continuously ejected from the nozzles 28 and a middle dot is formed on the recording medium. Likewise, when one of the ejection driving pulses, for example, the second ejection driving pulse DP2, is selected and applied to the piezoelectric vibrator 20, the ink is ejected once from the nozzles 28 and a small dot is formed on the recording medium. The large, middle, and small sizes of the dots are relative sizes and the sizes of the actual dots or the amounts of liquids of the dots are determined in accordance with the specifications of the printer 1. The in-printing minute vibration pulse VP1 is a driving pulse that has a driving voltage or a waveform so that the meniscuses of the nozzles 28 are minutely vibrated to the extent that no ink is ejected from the nozzles 28 in order to prevent the ink in the nozzles 28 from being thickened during the recording process. Further, since the configurations and operations of the ejection driving pulses DP1 to DP4 and the in-printing minute vibration pulse VP1 are known, the detailed description thereof will not be made.

Figure 5B:
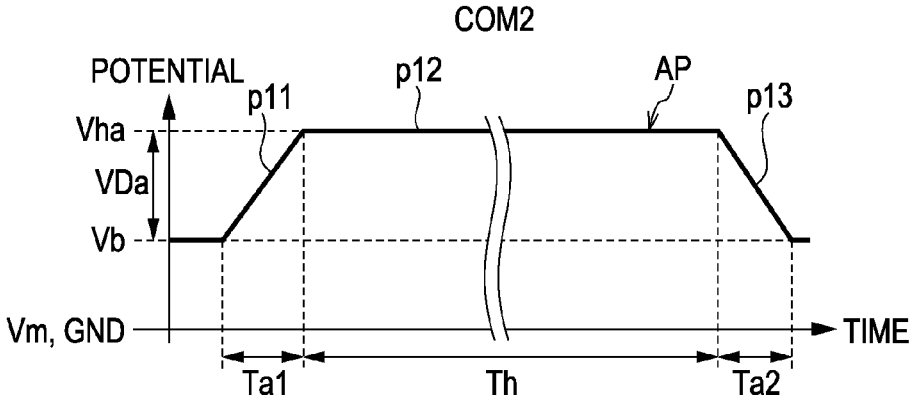

The driving signal generation unit 40 according to this embodiment generates a second driving signal COM2 used when the recording head 2 is moved in a region out of the recording region during the main scanning at an accelerated speed or a decelerated speed (hereinafter, simply referred to as an accelerated and decelerated speed movement time), as shown in FIG. 5B. The second driving signal COM2 includes an aging driving pulse AP (which is a kind of non-ejection driving waveform in a broad sense) used to intentionally accelerate the characteristic deterioration of the piezoelectric vibrator 20 by driving the piezoelectric vibrator 20. The aging driving pulse AP includes a first potential change portion p11 configured to change a potential from a reference potential Vb to an aging potential Vha toward the positive side (first polarity side), a potential hold portion p12 (which is a kind of non-ejection driving waveform in a narrow sense and corresponds to a direct-current voltage) configured to hold the aging potential Vha for a predetermined time, and a second potential change portion p13 configured to change the potential from the aging potential Vha toward the negative side (second polarity side) and return the potential to the reference potential Vb.

A driving voltage (which is a kind of driving parameter of the aging driving pulse AP) of the aging driving pulse AP, that is, a potential difference VDa between the reference potential Vb and the aging potential Vha is set to have a value obtained by deforming the piezoelectric vibrator 20 to the maximum extent (or near the maximum extent). A potential change ratio (which is a kind of driving parameter of the aging driving pulse AP and is simply referred to as a potential change ratio below) VDa/Ta1 per unit time of the first potential change portion p11 is set to have a value to the extent that no ink is ejected from the nozzles 28. Likewise, a potential change ratio VDa/Ta2 of the second potential change portion p13 is set to have a value to the extent that no ink is ejected from the nozzles 28. Further, a time duration Th (which is the time from the end point of the first potential change portion p11 to the start point of the second potential change portion p12 and is a kind of driving parameter of the aging driving pulse AP) of the potential hold portion p12 is set in accordance with the cumulative number of applications described below. The details thereof will be described later.

When the aging driving pulse AP is supplied to the piezoelectric vibrator 20, the piezoelectric vibrator 20 is curved to the inside of the pressure chamber 17 by the first potential change portion p11 and the pressure chamber 17 is contracted to the extent that no ink droplet is ejected. Then, the contraction state of the pressure chamber 17 is held for a predetermined time by the potential hold portion p12. At this time, since the curved state of the piezoelectric vibrator 20 is held, the deterioration in the piezoelectric characteristics of the piezoelectric vibrator 20 is accelerated. Thereafter, when the second potential change portion p13 is supplied, the piezoelectric vibrator 20 returns to the original state (which is the state corresponding to the reference potential Vb) and the volume of the pressure chamber 17 returns to a reference volume. An aging process using the aging driving pulse AP will be described later.

The CPU 38 of the printer controller 36 functions as a timing pulse generation unit that generates a timing pulse PTS based on an encoder pulse EP output from the linear encoder 10. The CPU 38 controls the transmission of the print data in synchronization with the timing pulse PTS, generation of the driving signal by the driving signal generation unit 40, and the like. Further, the CPU 38 generates a timing signal such as a latch signal LAT based on the timing pulse PTS and outputs the timing signal to the head control unit 53 of the recording head 2. The head control unit 53 controls application of the ejection driving pulses and the aging driving pulse of the driving signals COM to be applied to the piezoelectric vibrator 20 of the recording head 2 based on head control signals (the print data and the timing signal) from the printer controller 36.

The CPU 38 also functions as a counting unit that counts (cumulates) the number of times the driving waveforms (driving pulses) are applied to the piezoelectric vibrator 20. That is, whenever the driving pulse of the driving signal COM is applied to the piezoelectric vibrator 20, an addition value is added to the number of applications and the cumulative number of applications is stored (updated) in the storage unit 39 in correspondence with the nozzles 28 corresponding to the piezoelectric vibrator 20. For example, the addition value "1" is set for one ejection driving pulse. In this embodiment, a large dot is formed using the driving pulses DP1, DP2, DP3, and DP4 among the driving pulses shown in FIG. 5A, a middle dot is formed using the driving pulses DP1 and DP3, and a small dot is formed using the driving pulse DP2. Accordingly, when the large dot is formed, the addition value is set to "4." When the middle dot is formed, the addition value is set to "2," When the small dot is formed, the addition value is set to "1." Further, "0.5" is set for the in-printing minute vibration pulse VP1. Furthermore, the addition value of the aging driving pulse AP according to this embodiment is determined in accordance with the time duration Th of the potential hold portion p12. That is, the shorter the time duration Th is, the smaller the addition value is set. Conversely, the longer the time duration Th is, the larger the addition value is set.

Next, the band recording process of the printer 1 having the above-described configuration will be described. In the band recording process, a band (which is a kind of dot group) is formed on the recording sheet 6 by arranging main-scanning lines (raster lines) which are each formed by a plurality of dots arranged in the main scanning direction, and an image or the like is printed in the band unit.

Figure 6:
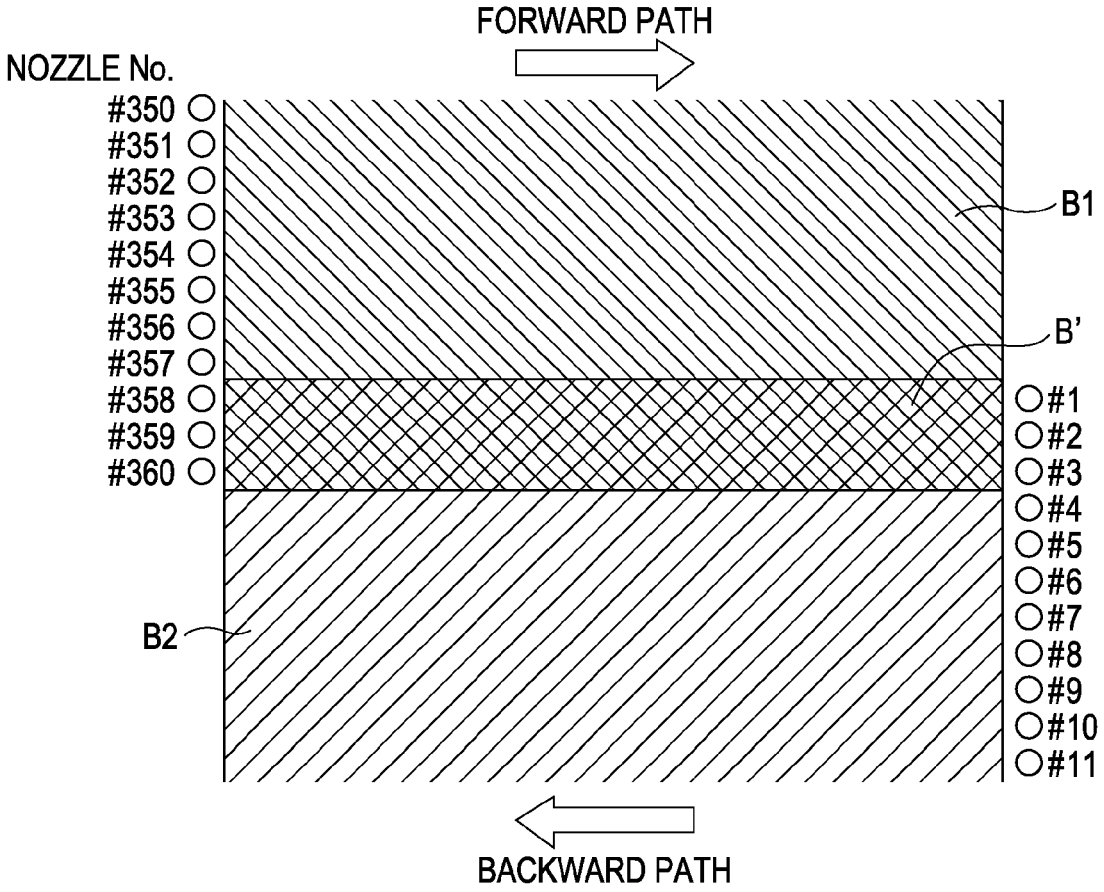
FIG. 6 is a schematic diagram illustrating a band recording process.

FIG. 6 is a schematic expanded diagram illustrating the vicinity of a boundary portion (joint portion between bands) of a first band B1 (corresponding to a first dot group) and a second band B2 (corresponding to a second dot group) recorded on the recording sheet 6. In FIG. 6, for example, one band B is recorded using all of the nozzles 28 from the 1st nozzle to the 360th nozzle by one-time main scanning. In FIG. 6, the nozzles 28 used to record the main-scanning lines and the nozzle number are shown for each main scanning line to facilitate the description. The formation ranges of bands are indicated by different hatches to distinguish the bands from each other, but the densities of the hatches do not indicate the densities of colors of the bands.

In this embodiment, for example, the ejection driving pulses are applied to the piezoelectric vibrators 17 corresponding to the nozzles 28 of the nozzle line to eject the ink toward the recording sheet 6 from the nozzles 28. Thus, each main-scanning line is formed for the nozzles 28 by landing the ink to landing regions and forming the dots so that the plurality of dots are arranged in the main scanning direction. Then, one band B is formed by 360 main-scanning lines continuously arranged in the sub-scanning direction. A first band B1 is a band formed in the forward movement of the recording head 2 and a second band B2 is a band formed in the backward movement of the recording head 2. In this embodiment, a printing process is performed so that a range (the end portion on the side of the second band B2) corresponding to the 358th to 360th nozzles 28 in the first band B1 and a range (the end portion on the side of the first band B1) corresponding to the 1st to 3rd nozzles 28 in the second band B2 overlap each other. The overlapping range is a boundary portion (overlapping range) B'.

Specifically, in the recording process of the forward movement (forward pass), a defined amount of ink is ejected from each nozzle 28 by applying the above-described driving pulse to the piezoelectric vibrator 20 corresponding to each of a total of 360 nozzles 28 from the 1st nozzle to the 360th nozzle of a nozzle line. The first band B1 is formed by landing the ink on the landing regions of the recording sheet 6 and forming the dots so that the dots are arranged in a matrix form. When the first band B1 is recorded, the recording sheet 6 is sent in the sub-scanning direction by the sheet feeding mechanism 8 to record the subsequent band B2. At this time, in the example of FIG. 6, the recording sheet 6 is moved in the sub-scanning direction by the 357 lines, and then the subsequent second band B2 is recorded continuously on the downstream side of the first band B1 in the sub-scanning direction. That is, the second band B2 is recorded so that the 358th main-scanning line to the 360th main-scanning line (the main-scanning lines recorded by the 358th to 360th nozzles 28) of the recorded first band B1 overlap the 1st main-scanning line to the 3rd main-scanning line (the main-scanning lines recorded by the 1st to 3rd nozzles 28) of the subsequent second band B2. Thus, in this embodiment, the boundary portion B' in which the adjacent bands overlap each other by three main-scanning lines is formed. The width of the boundary portion B' (the number of main-scanning lines) is not limited to the above-mentioned example, but may increase or decrease depending on an image to be recorded or specifications. Further, the number of times the recording head 2 performs the scanning process when the boundary portion B' is formed is not limited to two times, but the scanning process may be performed three times or more.

Since an image or the like is recorded in the boundary portion B' according to this embodiment by the forward movement and the backward movement, a process of thinning the dots is performed based on the print data. That is, for example, on the assumption that the number of dots formed to record the boundary portion B' by a one-time scanning process is 100%, that 50% of the number of dots is formed in the forward movement and that 50% of the number of dots is formed in the backward movement when the recording process is performed by the forward movement and backward movement. Alternatively, 30% of the dots is formed in the forward movement and 70% of the dots is formed in the backward movement. Thus, by performing the process of thinning the dots, the ink ejection frequency, that is, the number of ejections is reduced in the nozzles 28 recording the boundary portion B', compared to the nozzles 28 recording the portions other than the boundary portion B'.

Figure 7:
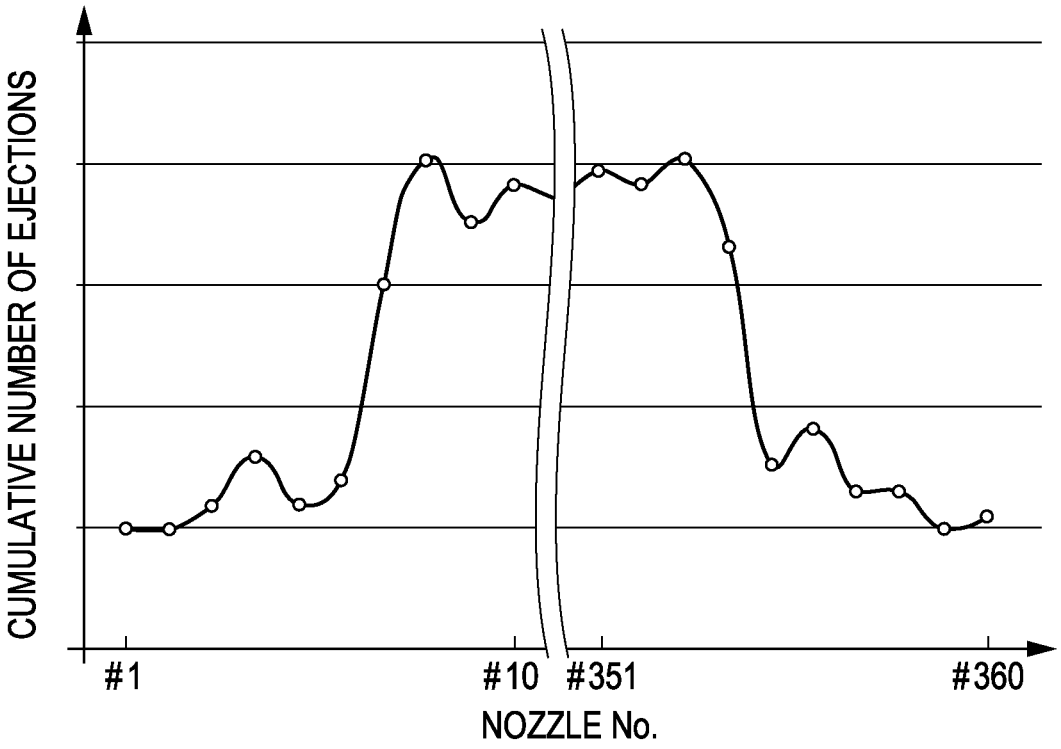
FIG. 7 is a graph illustrating an example of the cumulative number of ejections of each nozzle of the same nozzle line.

FIG. 7 is a graph illustrating an example of the cumulative number of ejections of each nozzle 28 of the same nozzle line 33. Here, the cumulative number of ejections is a value obtained by cumulating the number of times the ink is ejected from each nozzle 28 after the printer 1 is manufactured, to facilitate the description. Therefore, this cumulative number of ejections is different from the above-described cumulative number of applications in a narrow sense. As shown in FIG. 7, the cumulative number of ejections (the ejection frequency) of the nozzles 28 of the same nozzle line 33 are different from each other. In particular, in the printer 1 performing the band recording process according to this embodiment, the use ratios of the nozzles 28 located at the ends of the nozzle line 33 tend to be relatively low and the use ratios of the nozzles 28 located in the middle of the nozzle line 33 tend to be relatively high. Therefore, the piezoelectric characteristics of the piezoelectric vibrators 20 corresponding to the nozzles 28 located in the middle of the nozzle line 33 deteriorate more than that of the piezoelectric vibrators 20 corresponding to the nozzles 28 located at the ends of the nozzle line 33. Thus, if countermeasures are not taken, a difference in the ink ejection characteristics occurs between the middle and the ends of the nozzles 33. Therefore, there is a concern that unevenness or streaks may occur in an image or the like recorded in the recording sheet 6 and result in deterioration in the image quality.

In order to resolve this problem, in the printer 1 according to the invention, the aging process is performed in accordance with the cumulative number of applications in regions other than the recording region of the recording sheet 6 during the main scanning of the recording head 2 in order to match the characteristics of the piezoelectric vibrator 20 corresponding to the nozzles 28 as far as possible. Hereinafter, this countermeasure will be described.

Figure 8:
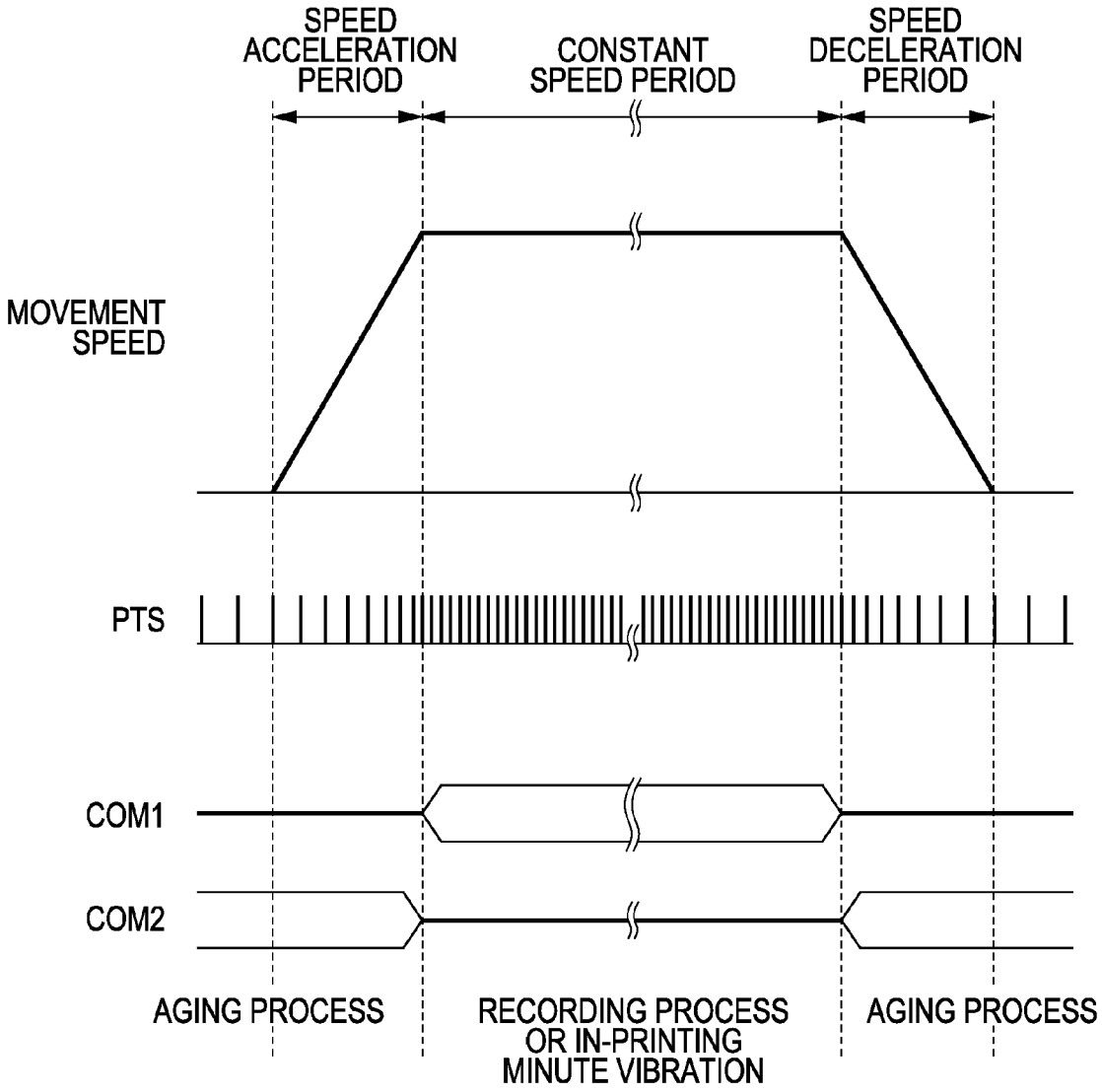
FIG. 8 is a timing chart illustrating a recording process and an aging process.

FIG. 8 is a timing chart illustrating the timings of the recording process and the aging process during the scanning of the recording head 2. When the recording head 2 of the printer 1 moves at a constant speed in the recording region of the recording medium 6 (constant speed period), as in FIG. 8, the driving pulse selected from the driving pulses of the first driving signal COM1 is applied to the piezoelectric vibrator 20 so that the recording process or an in-printing minute vibration process is performed. On the other hand, when the recording head 2 (the carriage 4) moves at an accelerated speed from the region outside the recording region to the recording region (speed acceleration period) and moves out of the recording region to a position at which the recording head 2 stops or the movement direction is changed (speed deceleration period), the aging process is performed on the piezoelectric vibrators 20 corresponding to the nozzles 28 using the aging driving pulse AP of the second driving signal COM2. In this embodiment, an application intensity (the extent that the character deterioration is accelerated) is differently set for each piezoelectric vibrator 20 by determining the time duration Th of the potential hold portion p12 of the aging driving pulse AP to be applied to the piezoelectric vibrator 20 corresponding to the nozzle 28 in accordance with the cumulative number of applications stored in correspondence with each nozzle 28. That is, the larger the cumulative number of applications is, the shorter the time duration Th of the potential hold portion p12 is set. The smaller the cumulative number of applications is, the longer the time duration Th of the potential hold portion p12 is set.

Accordingly, the aging process is performed relatively weakly on the piezoelectric vibrators 20 which have been more frequently used and thus have further deteriorated, whereas the aging process is performed relatively strongly on the piezoelectric vibrator 20 which have been less frequently used and thus have less deteriorated. Thus, since the aging process is stimulated for the piezoelectric vibrators 20 which has less deteriorated, the characteristics of the piezoelectric vibrators 20 which has less deteriorated can approach the characteristics of the piezoelectric vibrators 20 which have relatively further deteriorated. Therefore, a variation in the characteristics of the piezoelectric vibrators 20 corresponding to the nozzles 28 of the same nozzle line 33 can be reduced. As a result, since the ejection characteristics of the nozzles 28 can match each other as far as possible, the unevenness, streaks, or the like on the recording image can be reduced. Since the aging driving pulse AP causes no ejection of the ink, the ink is not unnecessarily consumed in the aging process. Further, since the aging process is performed outside the recording region in the scanning of the recording head 2, it is not necessary to provide a separate period of the aging process and deterioration in the throughput can be prevented. Since the processes of expanding and contracting the piezoelectric vibrators 20 are not repeated, the ink in the pressure chamber is not agitated. Therefore, the ink thickened near the nozzle can be prevented from being received to the pressure chamber. Accordingly, after the aging process, it is not necessary to perform a so-called flushing process of flushing out the ink to discharge the thickened ink. Further, it is not necessary to perform the aging process on the piezoelectric vibrators 20 which have been frequently used.

The invention is not limited to the above-described embodiment, but may be modified in various ways within the scope of the claims.

In the above-described embodiment, the configuration has been exemplified in which the time duration Th of the potential hold portion p12 of the aging driving pulse AP is changed in accordance with the cumulative number of applications, but the invention is not limited thereto. For example, the time duration Th of the potential hold portion p12 may be set to be constant and the driving voltage VDa may be changed in accordance with the cumulative number of applications. That is, in this case, as the larger the cumulative number of applications is, the lower the driving voltage VDa is set. The smaller the cumulative number of applications is, the larger the driving voltage VDa is set. Further, for example, a potential change ratio of the first potential change portion p11 or the second potential change portion p13 may be changed in accordance with the cumulative number of applications. That is, in this case, the larger the cumulative number of applications is, the smaller the potential change ratio (VDa/Ta1 or VDa/Ta2) is set. The smaller the cumulative number of applications is, the larger the potential change ratio is set. In this case, the potential change ratio is preferably set to a value within the range in which no ink is ejected from the nozzles 28.

Figure 9:
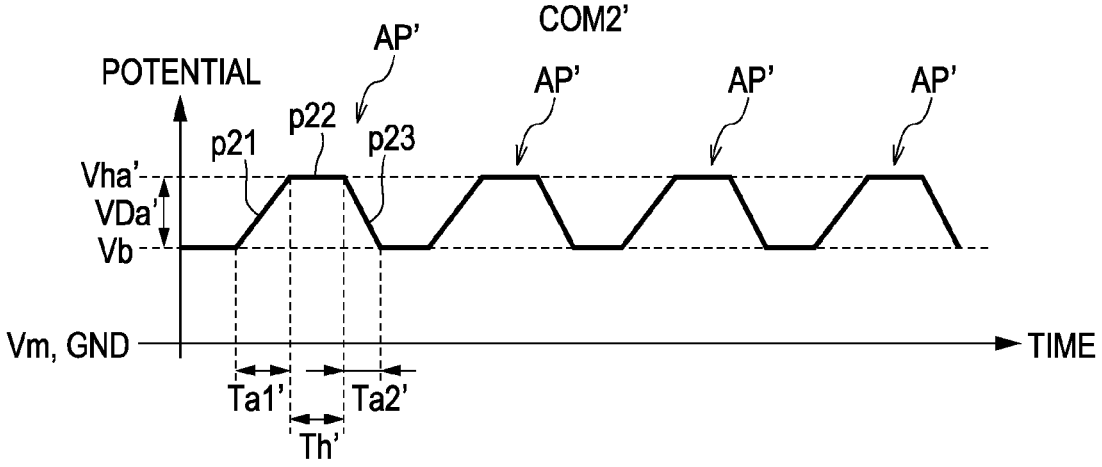
FIG. 9 is a waveform diagram illustrating the configuration of aging driving pulses according to a second embodiment.

FIG. 9 is a diagram illustrating an aging driving pulse AP' (which is a kind of non-ejection driving waveform of the invention and is a kind of trapezoidal wave) according to a second embodiment. The aging driving pulse AP' includes a first potential change portion p21 that changes a potential toward the positive side from a reference potential Vb to an aging potential Vha', a potential hold portion p22 that holds the aging potential Vha' for a predetermined time, and a second potential change portion p23 that changes the potential toward the negative side and returns the potential to the reference potential Vb.

The driving voltage of the aging driving pulse AP', that is, a potential difference VDa' between the reference potential Vb and the aging potential Vha' is set to be lower than the driving voltage VDa of the aging driving pulse AP exemplified in the first embodiment. Further, a potential change ratio VDa'/Ta1' of the first potential change portion p21 is set to have a value to the extent that no ink is ejected from the nozzles 28. Likewise, a potential change ratio VDa'/Ta2' of the second potential change portion p23 is set to have a value to the extent that no ink is ejected from the nozzles 28. Furthermore, a time duration Th' of the potential hold portion p22 is set to be sufficiently shorter than the time duration Th of the potential hold portion p12 of the aging driving pulse AP.

The aging driving pulse AP' according to this embodiment is approximate to a driving waveform used as a minute vibration driving pulse used in a general printer. Therefore, so-called out-of-printing minute vibration process is also performed by an aging process using the aging driving pulse AP' according to this embodiment. The number of times (which is a kind of driving parameter of the aging driving pulse AP) the aging driving pulse AP' is continuously applied to each piezoelectric vibrator 20 in a single aging process is determined in accordance with the cumulative number of applications stored in correspondence with each nozzle 28. That is, the larger the cumulative number of applications is, the smaller the number of continuous applications is. The smaller the cumulative number of applications is, the larger the number of continuous applications is. Accordingly, the aging process is performed by a relatively smaller number of applications on the piezoelectric vibrators 20 which have been more frequently used and thus have further deteriorated, whereas the aging process is performed by a relatively larger number of applications on the piezoelectric vibrator 20 which have been less frequently used and thus have less deteriorated. Thus, a variation in the characteristics of the piezoelectric vibrators 20 corresponding to the nozzles 28 of the same nozzle line 33 can be reduced. The addition value for the cumulative number of application per the aging driving pulse AP' according to this embodiment is set to 0.5 which is the same the addition value of the in-printing minute vibration pulse VP1.

According to the configuration described in this embodiment, since the minute vibration process is also performed by the aging process, it is not necessary to perform the minute vibration process, and therefore efficiency is good. Since the other configurations are the same as those of the above-described first embodiment, the description thereof will not be repeated.

Figure 10:
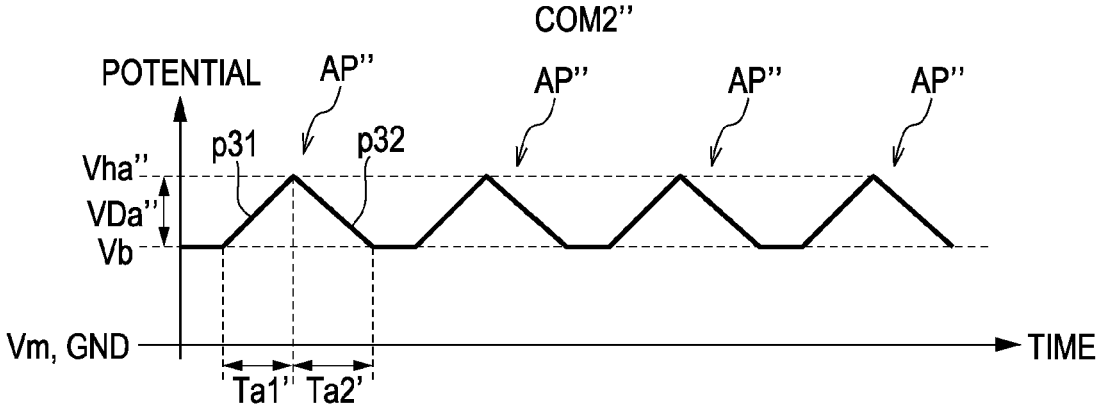
FIG. 10 is a waveform diagram illustrating the configuration of aging driving pulses according to a third embodiment.

FIG. 10 is a diagram illustrating an aging driving pulse AP" (which is a kind of non-ejection driving waveform of the invention) according to a third embodiment. The aging driving pulse AP" includes a first potential change portion p31 that changes a potential the positive side from a reference potential Vb to an aging potential Vha" and a second potential change portion p32 that changes the potential toward the negative side from the aging potential Vha" to the reference potential Vb. That is, the aging driving pulse AP" has no waveform component corresponding to the potential hold portion p12 of the aging driving pulse AP described above in the first embodiment or the potential hold portion p22 of the aging driving pulse AP' described above in the second embodiment.

The driving voltage of the aging driving pulse AP", that is, a potential difference VDa" between the reference potential Vb and the aging potential Vha" is set to be lower than the driving voltage VDa of the aging driving pulse AP exemplified in the first embodiment. Further, a potential change ratio VDa"/Ta1" of the first potential change portion p31 is set to have a value to the extent that no ink is ejected from the nozzles 28. Likewise, a potential change ratio VDa"/Ta2" of the second potential change portion p32 is set to have a value to the extent that no ink is ejected from the nozzles 28.

The aging driving pulse AP" according to this embodiment has a voltage waveform called a so-called triangular wave (case of Ta1'=Ta2') or a saw-toothed wave (case of Ta1'≠Ta2'). Therefore, since the conversion of the expansion and contraction directions of the piezoelectric vibrator 20 is steeper than that of the above-described first and second embodiments, a load on the piezoelectric vibrator 20 increases in the aging driving. Further, the number of times (which is a kind of driving parameter) the aging driving pulse AP" is continuously applied to each piezoelectric vibrator 20 in a single aging process is determined in accordance with the cumulative number of applications stored in correspondence with each nozzle 28. That is, the larger the cumulative number of applications is, the smaller the number of continuous applications is set. The smaller the cumulative number of applications is, the larger the number of continuous applications is set. Accordingly, the aging process is performed by a relatively smaller number of applications on the piezoelectric vibrators 20 which have been more frequently used and thus have further deteriorated, whereas the aging process is performed by a relatively larger number of applications on the piezoelectric vibrator 20 which have been less frequently used and thus have less deteriorated. Thus, a variation in the characteristics of the piezoelectric vibrators 20 corresponding to the nozzles 28 of the same nozzle line 33 can be reduced. The addition value for the cumulative number of application per the aging driving pulse AP" according to this embodiment is set to, for example, 3.

Since the other configurations are the same as those of the above-described embodiments, the description thereof will not be repeated.

In the above-described embodiments, the so-called flexible vibration type piezoelectric vibrator 20 has exemplified as the pressure generation unit. However, the invention is not limited thereto. For example, the invention is applicable to a so-called vertical vibration type piezoelectric vibrator. In this case, in regard to the exemplified waveforms of the driving signals (driving pulses), waveforms inverted in the potential change direction, that is, waveforms inverted vertically are used.

The invention is not limited to the printer, but is applicable to various ink jet printing apparatuses such as a plotter, a facsimile apparatus, and a copy machine or liquid ejecting apparatuses, such as a display manufacturing apparatus, an electrode manufacturing apparatus, and a chip manufacturing apparatus, other than the printing apparatuses, as long as such apparatuses are liquid ejecting apparatuses capable of driving a pressure generation unit by application of driving waveforms and controlling ejection of a liquid. In the display manufacturing apparatus, solutions of color materials of R (Red), G (Green), and B (Blue) are ejected from a color material ejecting head. Further, in the electrode manufacturing apparatus, a liquid-phase electrode material is ejected from an electrode material ejecting head. Furthermore, in the chip manufacturing apparatus, a solution of a bio-organic substance is ejected from a bio-organic substance ejecting head.

The entire disclosure of Japanese Patent Application No.: 2011-162895, filed Jul. 26, 2011 is expressly incorporated by reference herein.

What is claimed is:

1. A liquid ejecting apparatus comprising:

a liquid ejecting head that includes a nozzle group in which a plurality of nozzles are arranged and a pressure generation unit causing a change in pressure inside a pressure chamber communicating with the nozzle and that causes the pressure generation unit to eject a liquid from the nozzles;

a driving waveform generation unit that generates a driving waveform used to drive the pressure generation unit;

a control unit that controls ejection of the liquid by the liquid ejecting head; and a counting unit that counts a cumulative number of times the driving waveform is applied, wherein the driving waveform generation unit generates a non-ejection driving waveform, wherein a driving parameter of the non-ejection driving waveform includes at least one of a driving voltage, a potential change ratio per unit time, a hold time in which a potential is constantly held, and the number of times a pulse is continuously applied, and wherein the control unit drives the pressure generation unit using the non-ejection driving waveform set in accordance with the cumulative number of times the driving waveform is applied.

2. The liquid ejecting apparatus according to claim 1, wherein the control unit has a recording region where recording is performed in main scanning of the liquid ejecting head and a region outside the recording region and drives the pressure generation unit in the region outside the recording region using the non-ejection driving waveform set in accordance with the cumulative number of times the driving waveform is applied.

3. The liquid ejecting apparatus according to claim 1, wherein a driving intensity of the driving parameter is set lower when the cumulative number of times the driving waveform is applied is relatively larger than when the cumulative number of times the driving waveform is applied is relatively smaller.

4. The liquid ejecting apparatus according to claim 1, wherein the non-ejection driving waveform is a direct-current voltage.

5. The liquid ejecting apparatus according to claim 1, wherein the non-ejection driving waveform is a trapezoidal wave.

6. The liquid ejecting apparatus according to claim 1, wherein the non-ejection driving waveform is a triangular wave or a saw-toothed wave.

7. A method of controlling a liquid ejecting apparatus that includes a liquid ejecting head that includes a nozzle group in which a plurality of nozzles are arranged and a pressure generation unit causing a change in pressure inside a pressure chamber communicating with the nozzle and that causes the pressure generation unit to eject a liquid from the nozzles;

a driving waveform generation unit that generates a driving waveform used to drive the pressure generation unit;

a control unit that controls ejection of the liquid by the liquid ejecting head; and a counting unit that counts a cumulative number of times the driving waveform is applied, wherein the driving waveform generation unit generates a non-ejection driving waveform based on a driving parameter, wherein a driving parameter includes at least one of a driving voltage, a potential change ratio per unit time, a hold time in which a potential is constantly held, and the number of times a pulse is continuously applied, and wherein the control unit drives the pressure generation unit using the non-ejection driving waveform set in accordance with the cumulative number of times the driving waveform is applied.

8. The method according to claim 7, wherein the control unit has a recording region where recording is performed in main scanning of the liquid ejecting head and a region outside the recording region and drives the pressure generation unit in the region outside the recording region using the non-ejection driving waveform set in accordance with the cumulative number of times the driving waveform is applied.

* * * * *